US009737148B2

(12) United States Patent
Weiss

(10) Patent No.: US 9,737,148 B2
(45) Date of Patent: Aug. 22, 2017

(54) GUARD AND COMBINATION FOR ROTATABLE OR SWIVEL SEAT AND METHOD OF INSTALLING SAME

(71) Applicant: KGM Gaming LLC, Philadelphia, PA (US)

(72) Inventor: Lance Weiss, Yardley, PA (US)

(73) Assignee: KGM Gaming LLC, Philadelphia, PA (US)

( * ) Notice: Subject to any disclaimer, the term of this patent is extended or adjusted under 35 U.S.C. 154(b) by 109 days.

(21) Appl. No.: 14/822,357

(22) Filed: Aug. 10, 2015

(65) Prior Publication Data

US 2015/0342354 A1 Dec. 3, 2015

Related U.S. Application Data

(63) Continuation of application No. 13/800,069, filed on Mar. 13, 2013, now Pat. No. 9,192,236.

(60) Provisional application No. 61/676,422, filed on Jul. 27, 2012.

(51) Int. Cl.
*A47C 7/00* (2006.01)
*A47C 3/18* (2006.01)

(52) U.S. Cl.
CPC . *A47C 7/00* (2013.01); *A47C 3/18* (2013.01)

(58) Field of Classification Search
USPC ..... 297/344.21–344.23, 344.26
See application file for complete search history.

(56) References Cited

U.S. PATENT DOCUMENTS 2,702,075 A 2/1955 Richards
2,744,693 A * 5/1956 Albert ..... A01K 89/015 242/229
2,914,793 A * 12/1959 McMahan ..... E05D 11/02 108/139
3,424,423 A 1/1969 Hampton
(Continued)

FOREIGN PATENT DOCUMENTS

CA 406343 A 7/1942
CA 522637 A 3/1956
(Continued)

OTHER PUBLICATIONS

Photographs of a device for a chair, circa Jul. 2012.

*Primary Examiner* — Sarah McPartlin
(74) *Attorney, Agent, or Firm* — Panitch Schwarze Belisario & Nadel LLP

(57) ABSTRACT

A guard for a rotatable or swivel seat includes a first generally planar surface and an opposing second generally planar surface. The first and second surfaces define an inner peripheral edge that surrounds a central opening. A skirt extends generally perpendicularly from the first and second surfaces. The skirt generally surrounds and is spaced radially outwardly from the inner peripheral edge. The guard includes a plurality of equidistantly spaced-apart fastener points formed on or in at least one of the first and second surfaces. Each fastener point is spaced radially outwardly from the inner peripheral edge and radially inwardly from the skirt. The guard is attachable to a platform of a seat in both a first configuration wherein the skirt of the guard extends away from the platform of the seat and a second configuration wherein the guard is inverted from the first configuration.

5 Claims, 6 Drawing Sheets

(56) References Cited

U.S. PATENT DOCUMENTS

| | | | |
|---|---|---|---|
| 3,570,800 | A | 3/1971 | Cycowicz |
| 3,863,982 | A | 2/1975 | Sandham |
| 4,440,372 | A | 4/1984 | Wisniewski |
| 7,547,067 | B2 | 6/2009 | Keilhauer et al. |
| 7,654,616 | B2 | 2/2010 | Kinoshita et al. |
| 7,938,489 | B2 | 5/2011 | Nazari |
| 2011/0226925 | A1 | 9/2011 | Tsai |

FOREIGN PATENT DOCUMENTS

| | | | |
|---|---|---|---|
| CA | 727423 | A | 2/1966 |
| CA | 740250 | A | 8/1966 |
| CN | 201670127 | U | 12/2010 |
| CN | 102119816 | A | 7/2011 |
| JP | 2001-178578 | A | 7/2001 |

* cited by examiner

GUARD AND COMBINATION FOR ROTATABLE OR SWIVEL SEAT AND METHOD OF INSTALLING SAME

CROSS-REFERENCE TO RELATED APPLICATIONS

The present application is a continuation of co-pending U.S. patent application Ser. No. 13/800,069, filed Mar. 13, 2013, entitled "Guard and Combination for Rotatable or Swivel Seat and Method of Installing Same," which, in turn, claims priority to U.S. Provisional Patent Application No. 61/676,422, filed Jul. 27, 2012, entitled "Guard for Rotatable or Swivel Chairs."

BACKGROUND OF THE INVENTION

The present invention relates generally to a guard that at least partially covers and/or surrounds a conventional swivel of a rotatable chair or other seat.

Rotatable or swivel chairs (none shown) are well known. As shown in FIGS. 6-9 and 11, swivel chairs typically include one of a variety of swivels 12, 12'. Generally speaking, a swivel 12, 12' is a connection that allows at least a portion of an object (e.g., a seat of a chair) to rotate with respect to another portion of the object (e.g., a base of the chair). As shown in FIGS. 7, 9 and 11, conventional swivels 12, 12' typically include two spaced-apart and generally planar plates 28, namely a first plate 28*a* and a second plate 28*b*. One or more bearings (none shown) and/or a spring 50 (see FIG. 7) are typically positioned between the plates 28 and provide for the above-described relative motion or movement between the plates 28 and the structure (e.g., a platform 32 and/or a top plate 34, which are described in detail below) to which the plates 28 are secured. Conventional swivels 12, 12' may be referred to as auto-return swivels, 360 degree swivels, memory return swivels and non-return swivels, for example.

Certain conventional swivels 12 include self-clinching nuts 26, which are commonly referred to as PEM nuts. FIGS. 6 and 7 show a swivel 12 that includes self-clinching nuts 26. The self-clinching nuts 26 are generally fixed to or included within only one of the plates 28, such as the second plate 28*b*, of the swivel 12 and are sized and/or shaped to receive and engage at least a portion of a fastener 38, such as a threaded bolt or screw, (see FIGS. 5 and 6) therethrough. Other conventional swivels 12' lack self-clinching nuts 26, but instead include openings 44, 52 in both plates 28 with generally smooth (i.e., not threaded) interior surfaces for receipt and/or the passage of a fastener 38. FIGS. 9 and 11 show a swivel 12' without self-clinching nuts 26. A separate conventional nut (not shown) may be threaded onto at least a portion of the fastener 38 after the fastener 38 is inserted into one of the openings 44, 48, 52 of each of the first and second plates 28*a*, 28*b*, or at least a portion of the fastener 38 may engage a portion of a self-clinching nut 26 in another component of the chair.

Conventional rotatable or swivel chairs are often susceptible to a user or a bystander, particularly a child, intentionally or inadvertently contacting at least a portion of the swivel 12, 12' and thereby pinching or otherwise being injured during movement or rotation of the plates 28 of the swivel 12, 12'. Further, conventional swivels 12, 12' are at least somewhat unsightly or otherwise unattractive, and the use of such a swivel 12, 12' is undesirably inhibited by the collection of dust or dirt thereon or therein.

It has not yet been discovered how to create a guard that at least partially covers, surrounds, hides and/or conceals a conventional swivel 12. 12' and is reversible or useable in either of two orientations to accommodate conventional swivels 12, 12' that include and lack self-clinching nuts 26. The present invention accomplished the above objectives.

BRIEF SUMMARY OF THE INVENTION

Briefly stated, one aspect of the present invention is directed to a guard for a rotatable or swivel seat. The guard includes a first generally planar surface and an opposing second generally planar surface. The first and second surfaces define an inner peripheral edge that surrounds a central opening. A skirt extends generally perpendicularly from the first and second surfaces. The skirt generally surrounds and is spaced radially outwardly from the inner peripheral edge. The guard includes a plurality of equidistantly spaced-apart fastener points formed on or in at least one of the first and second surfaces. Each fastener point is spaced radially outwardly from the inner peripheral edge and radially inwardly from the skirt. Two spaced-apart clearance holes extend through the first and second surfaces and are positioned on opposing sides of the central opening. Each clearance hole is spaced-apart from each fastener point and each clearance hole is larger than each fastener point.

In another aspect, the present invention is directed to a combination a rotatable or swivel seat. The combination includes a platform of a seat, a top plate and a swivel positioned between the platform and the top plate. The swivel includes a first plate rotatably attached to a second plate. A guard is positioned between the platform and the top plate. The guard includes a first generally planar surface and an opposing second generally planar surface. The first and second surfaces define an inner peripheral edge that surrounds a central opening. A skirt extends generally perpendicularly from the first and second surfaces. The skirt generally surrounds and is spaced radially outwardly from the inner peripheral edge. The guard includes a plurality of equidistantly spaced-apart fastener points formed on or in at least one of the first and second surfaces. Each fastener point is spaced radially outwardly from the inner peripheral edge and radially inwardly from the skirt. Two spaced-apart clearance holes extend through the first and second surfaces and are positioned on opposing sides of the central opening. Each clearance hole is spaced-apart from each fastener point and each clearance hole is larger than each fastener point. The guard is attachable to the platform of the seat in both a first configuration wherein the skirt of the guard extends away from the platform of the seat and a second configuration wherein the guard is inverted from the first configuration.

In yet another aspect, the present invention is directed to a guard for a rotatable or swivel seat. The guard includes a first generally planar surface and an opposing second generally planar surface. The first and second surfaces define an inner peripheral edge that surrounds a central opening. A skirt extends generally perpendicularly from the first and second surfaces. The skirt generally surrounds and is spaced radially outwardly from the inner peripheral edge. The guard includes a plurality of equidistantly spaced-apart fastener points formed on or in at least one of the first and second surfaces. Each fastener point is spaced radially outwardly from the inner peripheral edge and radially inwardly from the skirt. The guard is attachable to a platform of a seat in both a first configuration wherein the skirt of the guard extends away from the platform of the seat and a second configuration wherein the guard is inverted from the first configuration.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
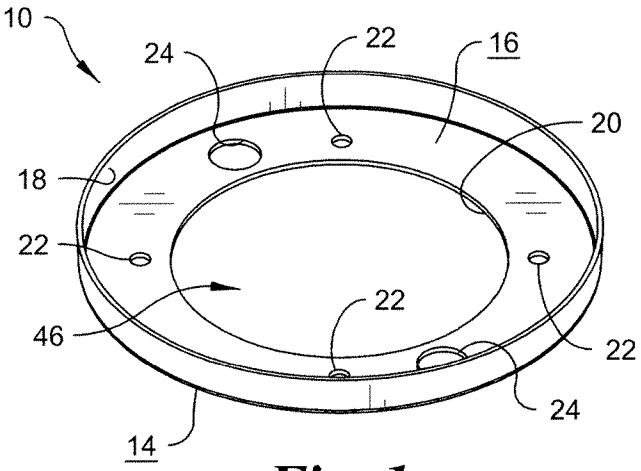
FIG. 1 is a perspective view of a guard for a swivel chair.

Certain terminology is used in the following description for convenience only and is not limiting. The words "lower," "bottom" and "top" designate directions in the drawings to which reference is made. The words "inwardly" and "outwardly" refer to directions toward and away from, respectively, the geometric center of the device(s), and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

Referring to the drawings in detail, wherein like numerals indicate like elements throughout, FIGS. 1-10 show a guard, generally designated 10, according to a preferred embodiment of the present invention. The guard 10 is preferably sized, shaped and/or configured to at least partially cover, surround, hide and/or conceal a conventional swivel 12, 12' (see FIGS. 5-8 and 12) of a rotatable or swivel chair (not shown). The guard 10 at least reduces the likelihood that a user of the chair or a bystander, such as a child, could intentionally or inadvertently contact at least a portion of the swivel 12, 12' and thereby pinch or otherwise be injured during movement or rotation of plates 28 of the swivel 12, 12'. The guard 10 is also a dust cover to protect the swivel 12, 12' and improves the aesthetic appearance of the chair by at least partially concealing the swivel 12, 12' therein.

Figure 2:
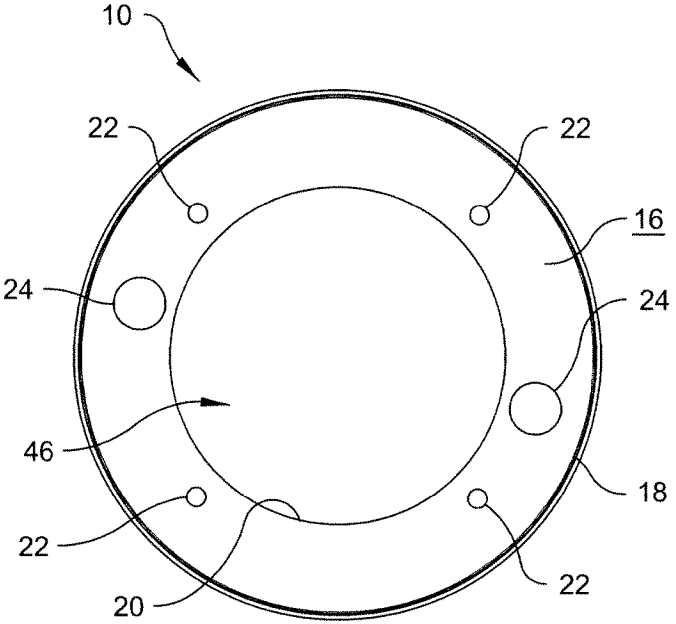
FIG. 2 is a top plan view thereof.
Figure 3:
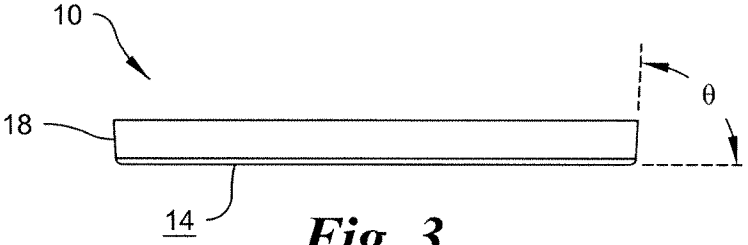
FIG. 3 is a side elevational view thereof.

Referring to FIGS. 1-3, the guard 10 preferably includes a first or exterior surface 14 and an opposing second or inner surface 16. Each of the exterior and interior surfaces 14, 16 of the guard 10 are preferably generally, if not perfectly, flat or planar. Each of the exterior and interior surfaces 14, 16 of the guard 10 are preferably entirely planar, such that no integral or unitarily formed projection extends outwardly therefrom. A skirt or sidewall 18 preferably extends at least generally perpendicularly from an outer periphery of each of the exterior and interior surfaces 14, 16 of the guard 10. The sidewall 18 may extend normally from the exterior and interior surfaces 14, 16, or at a particular angle θ (see FIG. 3), such as approximately 87 degrees. Each of the exterior and interior surfaces 14, 16 of the guard 10 preferably define an inner peripheral edge 20 that is preferably laterally spaced-apart from the sidewall 18 by a width of the exterior and interior surfaces 14, 16. The inner peripheral edge 20 thereby preferably surrounds a central opening 46 of the guard 10. The central opening 46 preferably extends completely through the guard 10, so as to extend from the exterior surface 14 to the interior surface 16 thereof.

Figure 10:
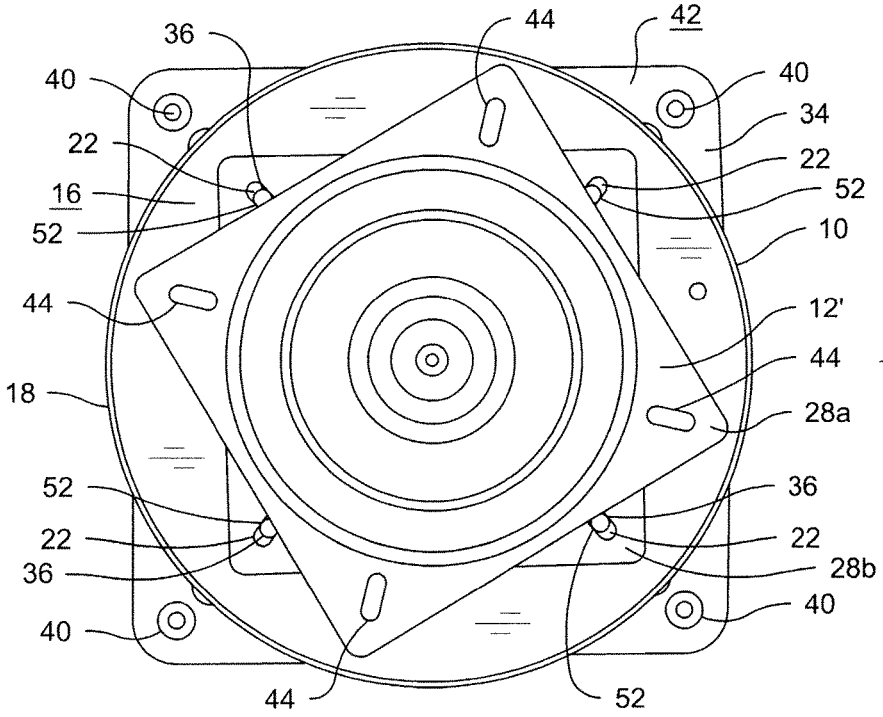
FIG. 10 is a top plan view of the swivel without self-clinching nuts on top of the guard, which is on top of the top plate, wherein the guard is shown in the second orientation.

FIGS. 1 and 2 show the sidewall 18 and the inner peripheral edge 20 as having a generally, if not exact, circular shape. The guard 10 is not limited to such a shape or the dimensions shown in FIGS. 1-3, as the guard 10 may have any size, shape and/or configuration that allows the guard 10 to provide the above-described benefits. For example, at least the sidewall 18 and the inner peripheral edge 20 of the guard 10 may have a square or rectangular shape when viewed from above or below, if desired. As shown in FIG. 10, an outer diameter of the sidewall 18 of the guard 10 is preferably at least slightly greater than the greatest diameter of the swivel plates 28 of the swivel 12, 12'. The outer diameter of the guard 10 is preferably approximately ten and one quarter inches, and the inner peripheral edge 20 preferably has a diameter of approximate six and one half inches. Further, a height of the sidewall 18 of the guard 10 is preferably at least slightly less than a height of the swivel 12, 12', such as approximately one inch.

Referring again to FIGS. 1 and 2, the guard 10 includes at least one and preferably four equal distantly spaced-apart fastener points or holes 22. Each fastener hole 22 is preferably spaced radially outwardly from the inner peripheral edge 20 and radially inwardly from the sidewall 18. Each fastener hole 22 also preferably extends completely through the guard 10, so as to extend from the exterior surface 14 to the interior surface 16 thereof. Each fastener hole 22 preferably has a diameter of less than one half inch.

As shown in FIG. 2, any one of the fastener holes 22 is preferably spaced-apart from an adjacent fastener hole 22 by a distance of five and one half inches. The fastener holes 22 are not limited to such a spacing, but such spacing is preferred so as to match the corresponding spacing of fastener openings 44, 48, 54 in the first plate **28*a* and/or the second plate 28*b* of the swivel 12, 12', as described in detail below. The guard 10 may include more than four fastener holes 22**, if desired.

Alternatively, the guard 10 may include no fastener holes 22 at the time of initial formation of the guard 10 to permit the fastener holes 22 to be custom fit to a user and drilled at the time of installation. For example, the fastener holes 22 may simply be indicia on or in one of or both of the exterior and interior surfaces 14, 16, to indicate where a hole should be formed in the guard 10. The term "indicia" is defined broadly herein as any marking, such as at least a slight indentation, a different color from another portion of the guard 10, or even an ink marking, that indicates or highlights a portion through which a fastener should extend.

In addition, the guard 10 includes at least one and preferably two spaced-apart clearance holes 24. Each clearance hole 24 is preferably spaced radially outwardly from the inner peripheral edge 20 and radially inwardly from the sidewall 18. Each clearance hole 24 preferably extends completely through the guard 10, so as to extend from the exterior surface 14 to the interior surface 16 thereof. Each clearance hole 24 preferably has a diameter of approximately one inch.

As shown in FIG. 2, each fastener hole 22 and each clearance hole 24 is preferably generally, if not exactly, circular in shape when viewed from above or below. However, the fastener holes 22 and the clearance holes 24 may have any size, shape and/or configuration that allows the guard 10 to provide the above-described benefits. It is preferred that each clearance hole 24 is of a sufficient diameter to permit at least a portion of a tool (not shown), such as a shaft of a screwdriver or socket wrench, to extend therethrough. Therefore, it is preferred that a diameter of each clearance hole 24 is at least two times greater than a diameter of each fastener hole 22. However, the diameter of each clearance hole 24 is preferably significantly less (e.g., four times less) than a diameter of the central opening 46 of the guard 10.

The guard 10 is preferably formed of a generally opaque, at least slightly flexible polymeric material. However, the guard 10 may be formed of any material, such as a metallic material, that allows the guard 10 to provide the above-described benefits. It is also preferred that the guard 10 is injection molded, but the guard 10 may be formed by any of a variety of methods, such as by stamping or pressing. The guard 10 may also be formed of a generally translucent or transparent material, if desired.

Figure 5:
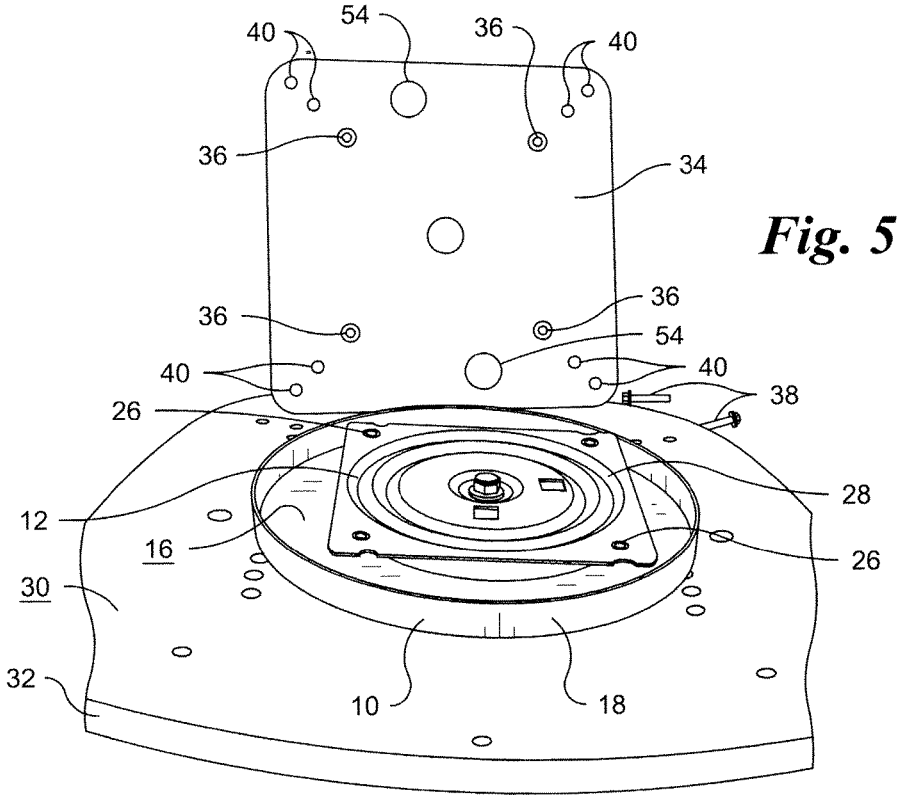
FIG. 5 is a perspective view of the combination of components shown in FIG. 4, wherein the top plate is shown separated from the guard to expose a conventional swivel with self-clinching nuts.
Figure 6:
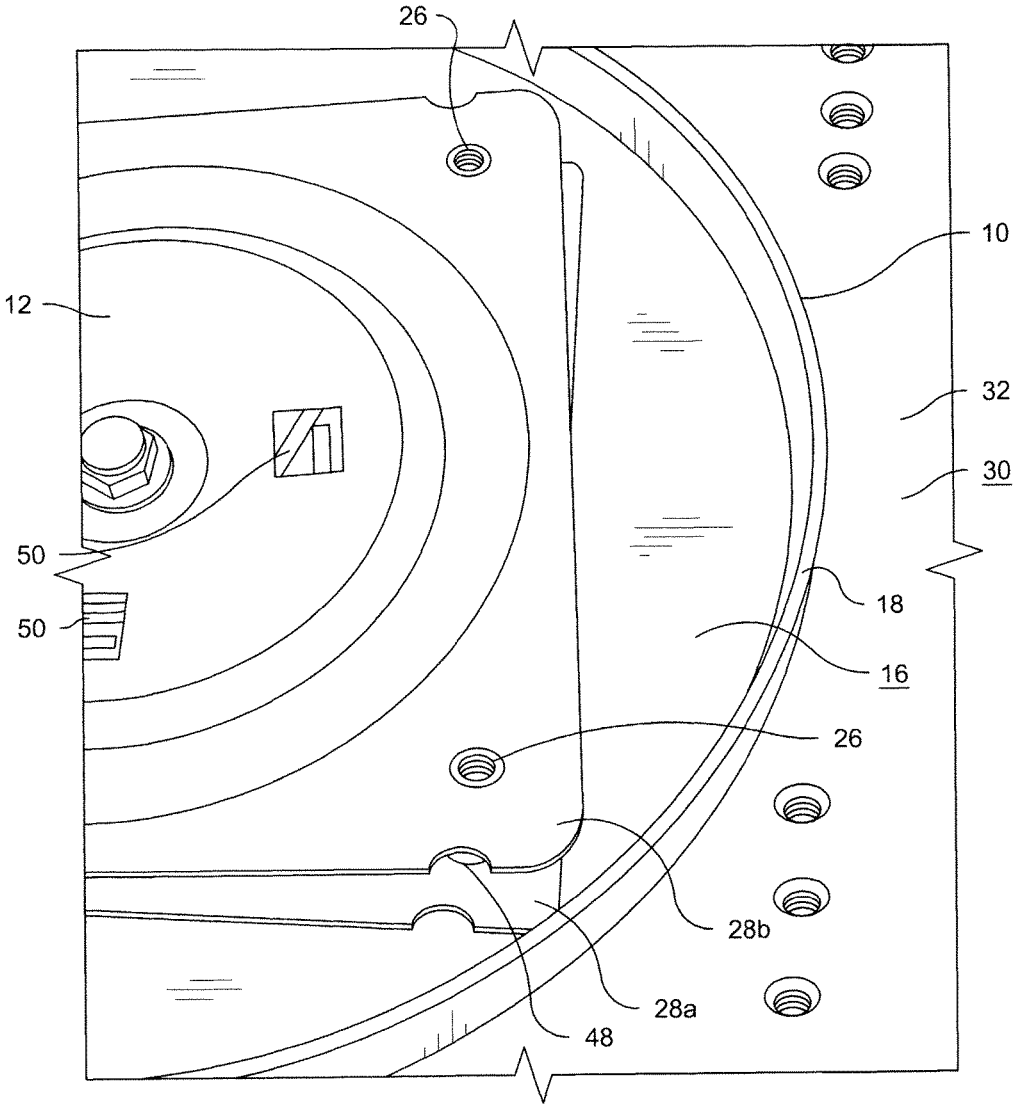
FIG. 6 is an enlarged view of a portion of the swivel guard and the platform of the seat shown in FIG. 5.
Figure 7:
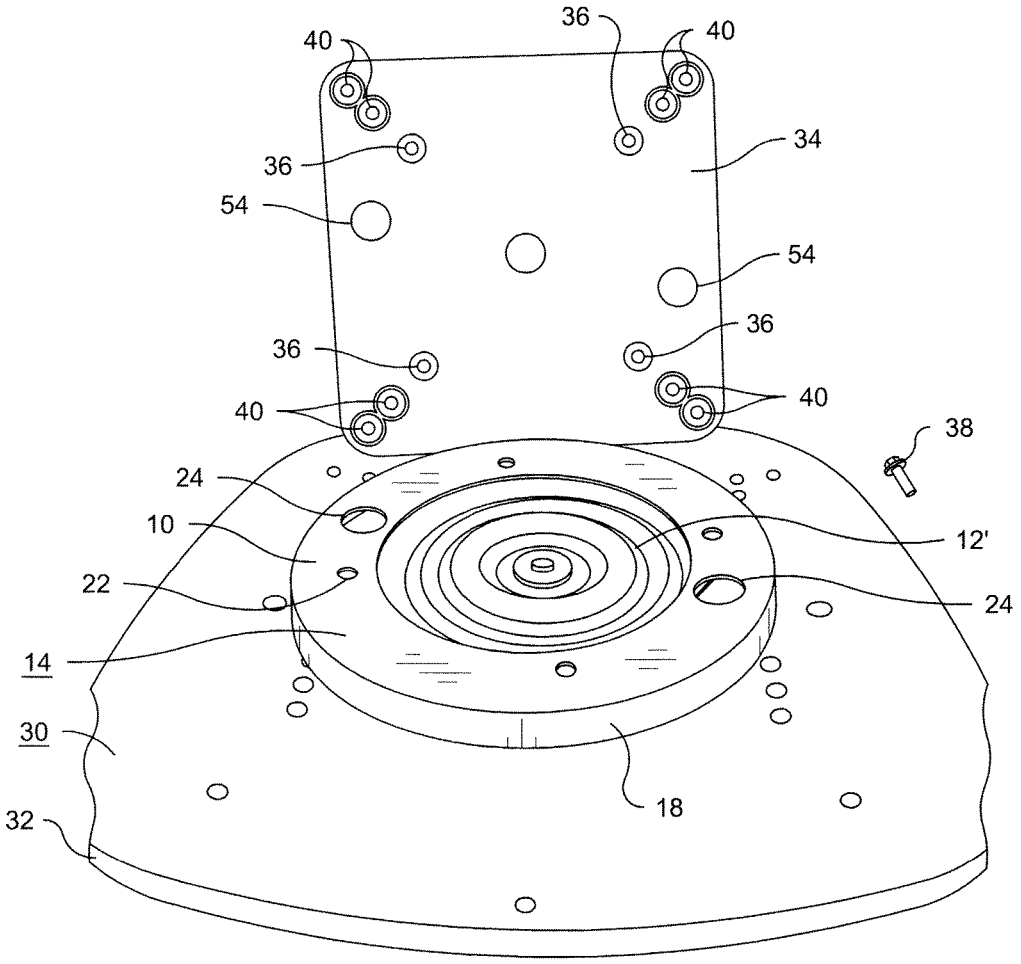
FIG. 7 is a perspective view of a portion of a conventional swivel without self-clinching nuts surrounded by the guard in a second orientation and the platform of the seat, wherein the guard is shown in a second orientation.

Referring now to FIGS. 4-10, the guard 10 is preferably usable or installable into/onto the chair in either a first or upward orientation (see FIGS. 4-6) or an opposing inverted or downward second orientation (see FIG. 7). The orientation in which the guard 10 is mounted or otherwise installed on the chair is dependent upon whether the chair is built or otherwise constructed with a swivel 12 that includes self-clinching nuts 26 or a swivel 12' that lacks self-clinching nuts 26, as described above. For example, if the chair has a swivel 12 that includes self-clinching nuts 26, the guard 10 is installed or mounted in the first configuration. Alternatively, if the chair has a swivel 12' without self-clinching nuts 26, the guard 10 is installed or mounted in the second configuration. The above-described benefits of the guard 10 are equally applicable regardless of the orientation of the guard 10 in/on the chair.

Figure 4:
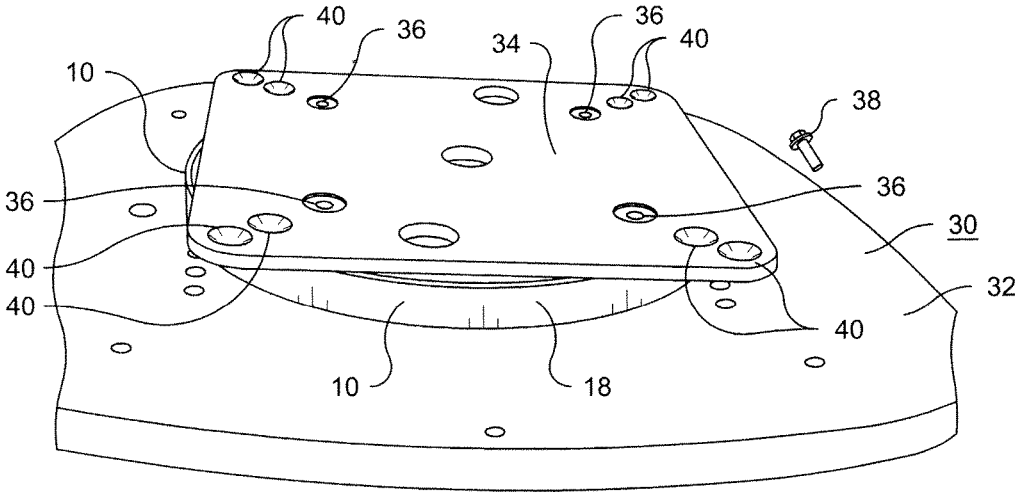
FIG. 4 is a perspective view of the guard of FIG. 1 positioned between a top plate and a lower surface of a platform of a seat of the chair, wherein the guard is shown in a first orientation.

Referring specifically to FIGS. 4-6, when mounting or attaching the guard 10 to a chair with the swivel 12 having self-clinching nuts 26, the guard 10 is preferably first placed on a bottom surface 30 of a platform 32 of the chair in the first orientation. The bottom surface 30 of the platform 32 is opposite to the surface on which a user would sit. Therefore, it may be easier or even necessary to invert at least a portion of the chair to properly attached and/or mount the guard 10 to the platform 32, as described herein.

In the first orientation, the exterior surface 14 of the guard 10 is preferably flush and/or in abutting contact with the bottom surface 30 of the platform 32. The fastener holes 22 of the guard 10 are preferably aligned with corresponding fastener holes (not shown in FIGS. 4-6, but see the fastener holes 56 in FIG. 8) in the bottom surface 30 of the platform 32 of the chair. The fastener holes 56 of the platform 32 may include self-clinching nuts 26, as shown but not numbered in FIG. 6. The first plate 28*a* of the swivel 12 with self-clinching nuts 26 is then preferably placed on the interior surface 16 of the guard 10. Fastener openings 48 (only one shown in FIG. 6) in the first plate 28*a* of the swivel 12, which is in abutting contact with the guard 10, are preferably aligned with the fastener holes 22 of the guard 10. It may be advantageous to at least temporarily rotate one of the plates 28*a*, 28*b* of the swivel 12 with respect to the other plate 28*a*, 28*b* to provide easier access to the fastener openings 48 of the first plate 28*a* of the swivel 12. One of the fasteners 38 is then preferably inserted through each corresponding combination of openings 48 in the first plate 28*a* of the swivel 12, the fastener holes 22 of the guard 10 and the fastener holes 56 of the platform 32 of the chair to generally secure the first plate 28*a* of the swivel 12 to the guard 10 and the platform 32.

As shown in FIG. 4, a top plate 34 is then preferably placed on top of the guard 10 and/or the second plate 28*b* of the swivel 12. Thus, the top plate 34 generally rests on at least one end of and possibly both of the sidewall 18 of the guard 10 and the second plate 28*a* of the swivel 12. Corresponding openings 36 of the top plate 34 are preferably aligned with the self-clinching nuts 26 of the second plate 28*b* of the swivel 12. One of the fasteners 38 is then preferably inserted through each corresponding combination of the openings 36 of the top plate 34 and the self-clinching nuts 26 of the second plate 28*b* of the swivel 12, thereby fixedly attaching the top plate 34 to the second plate 28*b* of the swivel 12.

The top plate 34 is preferably previously or subsequently attached to legs or a base (none shown) of the chair by inserting one of the fasteners 38 through each chair hole 40 in the top plate 34. If the top plate 34 is subsequently attached to the legs or the base of the chair, it may be advantageous to invert the secured combination of the top plate 34, the swivel 12, the guard 10 and the platform 32 (from the orientation shown in FIG. 4) and then place the combination directly on top of a portion of the legs or the base of the chair. It should be noted that it is preferred that the clearance holes 24 of the guard 10 are not specifically utilized or even necessary in the first orientation of the guard 10.

Figure 8:
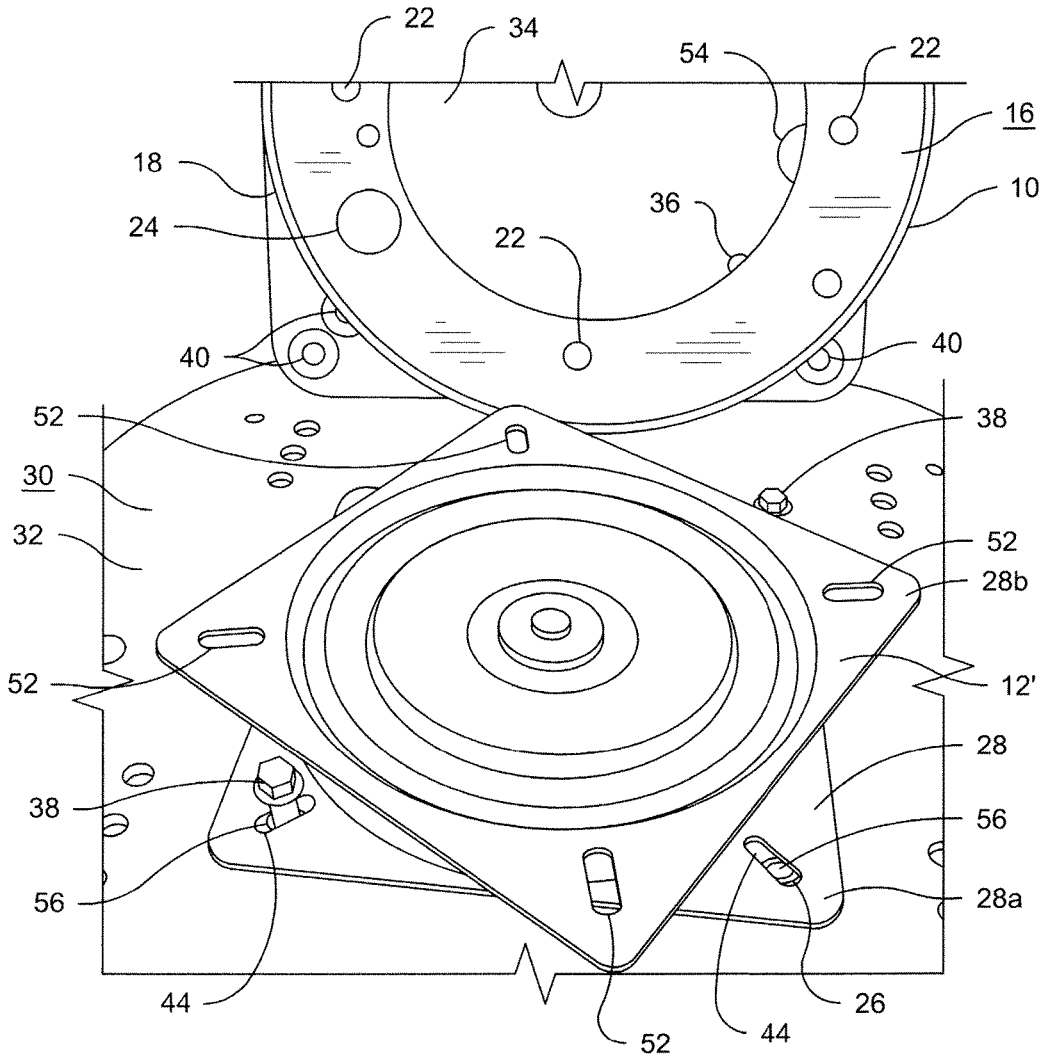
FIG. 8 is an enlarged view of the swivel and the platform of the seat shown in FIG. 7, wherein the guard is separated from the swivel for clarity.
Figure 9:
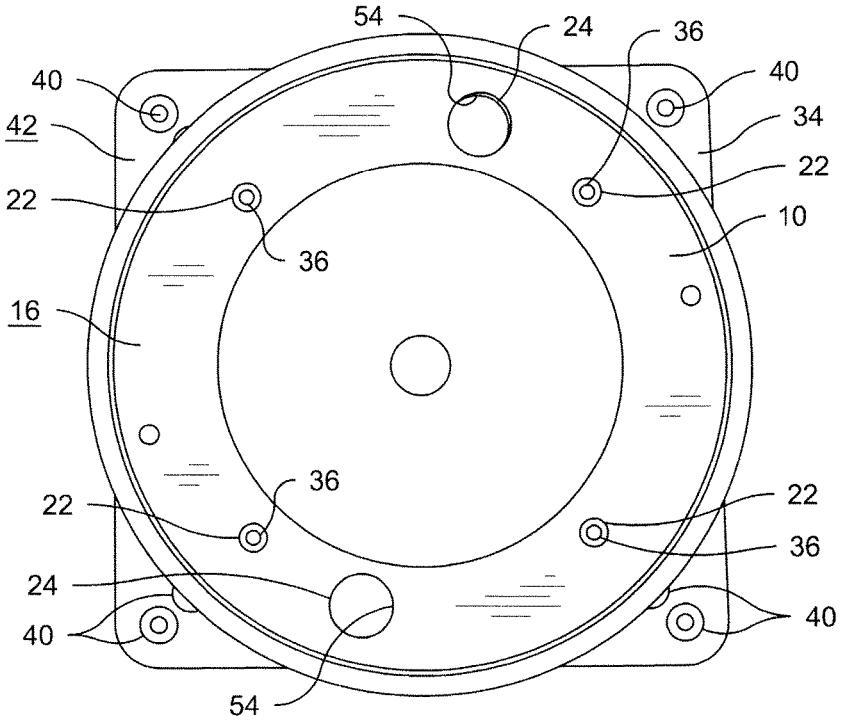
FIG. 9 is a top plan view of the guard placed on top of the top plate, wherein the guard is shown in the second orientation.

FIGS. 7-10 show various steps and/or ways to mount and/or attach the guard 10 in the second orientation to the chair. As shown in FIGS. 9 and 10, the exterior surface 14 of the guard 10 is preferably placed flush and/or in abutting contact with a top surface 42 of the top plate 34. It is preferred that the fastener holes 22 of the guard 10 are aligned with the openings 36 of the top plate 34, as shown in FIGS. 9 and 10. The swivel 12' without self-clinching nuts 26 is then preferably placed on the interior surface 16 of the guard 10, such that second fastener openings 52 in the second plate 28*b* of the swivel 12' are aligned with both corresponding the fastener holes 22 of the guard 10 and the openings 36 of the top plate 34. One of the fasteners 38 is then preferably inserted through each corresponding combination of the second fastener openings 52 of the second plate 28*b* of the swivel 12', the fastener holes 22 of the guard 10 and the openings 36 of the top plate 34, thereby fixedly attaching the top plate 34 to the second plate 28*b* of the swivel 12' with the guard 10 therebetween. As described above, to provide access to allow the fasteners 38 to be inserted through the desired portions of the above components, the plates 28 of the swivel 12' are preferably rotated with respect to each other or otherwise misaligned.

As shown in FIGS. 8 and 10, the first plate 28*a* of the swivel 12' is preferably sufficiently rotated with respect to the second plate 28*b*, such that each first fastener opening 44 in the first plate 28*a* of the swivel 12' is aligned with the clearance hole 24 of the guard 10 and a corresponding access opening 54 in the top plate 34. Such relative rotation or misalignment of the plates 28 allows a user to first invert the entire combined swivel 12', guard 10 and top plate 34 and then insert at least a portion of a tool (none shown), such as a socket wrench or screwdriver, into and through one of the access openings 54 of the top plate 34 and into and through one of the clearance holes 24 of the guard 10 to attach the first plate 28*a* of the swivel 12' directly to the bottom surface 30 of the platform 32. The second plate 28*b* of the swivel 12', the top plate 34 and the guard 10 are then preferably rotated a sufficient amount, such as approximately ninety degrees, until another one of the first fastener openings 44 in the first plate 28*a* of the swivel 12' is aligned with one of the clearance holes 24 of the guard 10 and the corresponding access opening 54 in the top plate 34. Another fastener 38 is then preferably inserted therein to attach the first plate 28*a* of the swivel 12' directly to the bottom surface 30 of the platform 32. The above steps are preferably repeated until all four first fastener openings 44 in the first plate 28*a* of the swivel 12' have one of the fasteners 38 extending therethrough and into the platform 32. Thus, it is envisioned that the second plate 28*b* of the swivel 12', the top plate 34 and the guard 10 will be rotated approximately two hundred seventy degrees to fully attach the first plate 28*a* of the swivel 12' to the platform 32

It should be noted that FIG. 7 shows the guard 10 in the second orientation against the bottom surface 30 of the platform 32, such that a free end of the sidewall 18 of the guard 10 directly contacts the bottom surface 30 of the platform 32. While FIG. 7 does not show the first plate 28*a* of the swivel 12' being installed in the preferred order of operations discussed above, FIG. 8 shows how at least a portion of the first plate 28*a* of the swivel 12' is preferably attached in flush engagement to the bottom surface 30 of the platform 32, with the guard 10 and the top plate 34 separated therefrom for clarity.

The platform 32 of the seat is shown herein as being a generally flat or planer component. However, the platform 32 may include on or more portions that are angled or otherwise is not planar, so as to provide a certain degree of tilt when a user sits down on the chair. In such an instance, to maintain the guard 10 in a generally level position in an assembled configuration, one or more spacers or risers (not shown) having a predetermined thickness or height may be attached and/or mounted to the exterior surface 14 and/or the interior surface 16 of the guard 10, depending upon the orientation of the guard 10 and the type of swivel 12, 12' used.

It will be appreciated by those skilled in the art that changes could be made to the embodiments described above without departing from the broad inventive concept thereof. For example, the particular steps or order of operation of combining or attaching the components of the chair may be modified or otherwise changed. It is understood, therefore, that this invention is not limited to the particular embodiments disclosed, but it is intended to cover modifications within the spirit and scope of the present invention as defined by the appended claims.

I claim:

1. A guard for a rotatable or swivel seat, the guard comprising:

a first generally planar surface;

an opposing second generally planar surface, the first and second surfaces defining an inner peripheral edge that surrounds a central opening extending between the first and second surfaces;

a skirt extending generally perpendicularly from an outer periphery of the first and second surfaces, the skirt having a top edge and an opposing bottom edge, wherein at least one of said edges is co-planar with at least one of the first and second generally planar surfaces, and the skirt generally surrounding and spaced radially outwardly from the inner peripheral edge;

a plurality of equidistantly spaced-apart fastener points formed on or in at least one of the first and second surfaces, each fastener point being spaced radially outwardly from the inner peripheral edge and radially inwardly from the skirt; and two spaced-apart clearance holes extending through the first and second surfaces, the clearance holes being positioned on opposing sides of the central opening, each clearance hole being spaced-apart from each fastener point, each clearance hole being larger than each fastener point.

2. The guard according to claim 1, wherein the plurality of equidistantly spaced-apart fastener points include at least one of:

a hole extending through the first and second surfaces;

an indentation in at least one of the first and second surfaces; and indicia on at least one of the first and second surfaces.

3. The guard according to claim 1, wherein the skirt and the central opening are circular.

4. The guard according to claim 1, wherein an outer diameter of the guard is approximately ten and one quarter inches, and the inner peripheral edge has a diameter of approximate six and one half inches.

5. The guard according to claim 1, wherein each fastener point is spaced-apart from an adjacent fastener point by a distance of five and one half inches.

* * * * *